US007481008B2

(12) United States Patent
Lusk

(10) Patent No.: US 7,481,008 B2
(45) Date of Patent: Jan. 27, 2009

(54) TIGER LILY STYLE SMART SANDAL

(76) Inventor: Tyla Joy Lusk, 587 Sanford Dr., Fort Myers, FL (US) 33919

( * ) Notice: Subject to any disclaimer, the term of this patent is extended or adjusted under 35 U.S.C. 154(b) by 319 days.

(21) Appl. No.: 11/433,887

(22) Filed: Aug. 7, 2006

(65) Prior Publication Data

US 2008/0028636 A1 Feb. 7, 2008

(51) Int. Cl.
*A43B 3/24* (2006.01)

(52) U.S. Cl. ..... 36/100; 36/11.5; 36/136

(58) Field of Classification Search ..... 36/100, 36/101, 136, 137, 11.5
See application file for complete search history.

(56) References Cited

U.S. PATENT DOCUMENTS 2,801,477 A * 8/1957 Adams et al. ..... 40/636
2,887,792 A * 5/1959 Staff ..... 36/100
3,011,281 A * 12/1961 King ..... 36/11.5
5,802,743 A * 9/1998 Chien ..... 36/141
6,769,204 B1 * 8/2004 Phillips ..... 36/136
7,083,296 B2 * 8/2006 Chiang ..... 362/103
2002/0112372 A1 * 8/2002 Coomes ..... 36/11.5
2004/0093765 A1 * 5/2004 Baldwin ..... 36/101
2005/0259410 A1 * 11/2005 Chiang ..... 362/103
2006/0254085 A1 * 11/2006 Mollicone ..... 36/11.5

* cited by examiner

*Primary Examiner*—Marie Patterson

(57) ABSTRACT

A ladies thong sandal that has interchangeable parts so that the appearance and style of the sandal can be changed quickly and easily. When a sandal of a different color is desired, the strips can than be changed and a clip on accessory can be added to give a new look entirely to the sandal.

1 Claim, 1 Drawing Sheet

DRAWING -1-
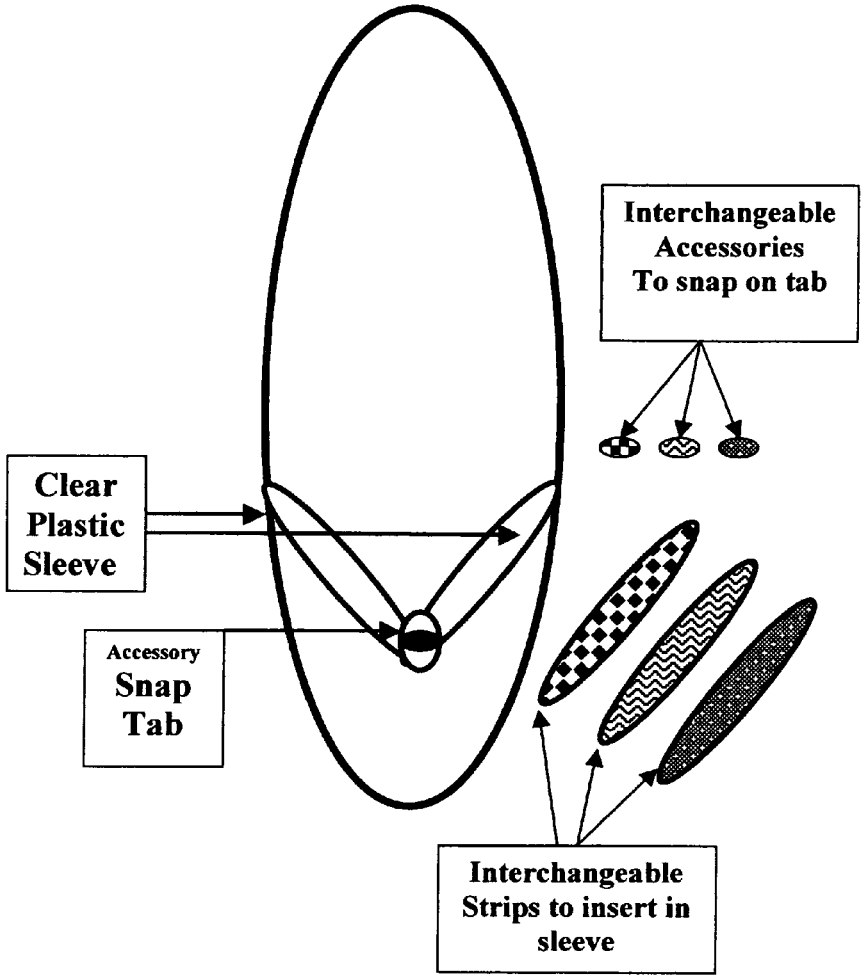

TIGER LILY STYLE SMART SANDAL

An EVA thong or sandal with a receptive clear plastic sleeve as part of the upper of the shoe. This clear plastic sleeve will receive exchangeable strips that may have a different color, pattern, or texture thus changing the stylish look of the footwear.

At the junction where the right side plastic sleeve meets the left side plastic sleeve, which is also the center of the sleeve, an accessory may be clipped in place on a tab snap. The accessory can be anything from a sports emblem to elegant rhinestones, flowers or colored faux gemstones completing the new look for the entire shoe.

Several sets of insert able strips and add-on accessories will be included at purchase with more option interchangeable strips and accessories available for future updates.

The emphasis is on ease of use. The fashion look can be easily changed by the consumer by simply slipping a new and different interchangeable strip into the sleeve and/or clipping one of many optional accessories onto the snap tab.

BRIEF DESCRIPTION OF DRAWINGS

FIG. 1 shows a preferred embodiment of the sandal.

BRIEF SUMMARY OF THE INVENTION

The Tiger Lily Style Smart Sandal is a thong or sandal that allows the consumer to interchange specific or custom, decorative style strips on the upper of the shoe to change the look of the thong or sandal. It also allows the buyer to change the look of the sandal by providing a method of attaching an interchangeable decorative accessory to a snap tab located on the center of the shoe upper.

BACKGROUND OF THE INVENTIONS

The invention was conceived because of a desire to be stylish without having to purchase several pairs of shoes. Traveling is also easier with these as you only have to pack one pair with the multiple strips and accessories.

DETAILED DESCRIPTION OF THE INVENTION

The Tiger Lily Style Smart Sandal is a thong or sandal with the means to allow interchangeable strips to become a part of the upper of the shoe. By inserting a specific strip into a receptive sleeve on the top of the footwear the buyer can change the fashion look of the sandal. In addition, by attaching a decorative accessory to the upper in the center of same receptive sleeve, the consumer can change the appearance of the piece from "fun" to "elegant".

The invention claimed is:

1. A sandal system comprising:

a sole and an upper;

the upper comprising a pair of clear receptacle sleeves with openings and a single fastener for closing the openings and to receive decorative accessories;

a plurality of different decorative strips shaped to fit into the receptacle sleeves;

a plurality of different decorative accessories for attachment to the fastener.

* * * * *